US006328556B1

(12) United States Patent
Sõmer

(10) Patent No.: US 6,328,556 B1
(45) Date of Patent: Dec. 11, 2001

(54) GAS BURNER FOR STOVE

(75) Inventor: Heinz Sõmer, Lennestadt (DE)

(73) Assignee: Isphording Germany GmbH, Attendorn (DE)

( * ) Notice: Subject to any disclaimer, the term of this patent is extended or adjusted under 35 U.S.C. 154(b) by 0 days.

(21) Appl. No.: 09/612,047

(22) Filed: Jul. 7, 2000

(30) Foreign Application Priority Data

Jul. 8, 1999 (DE) ..... 199 31 686

(51) Int. Cl.[7] ..... F23D 14/06; F24C 3/08; F24C 3/10

(52) U.S. Cl. ..... 431/266; 431/354; 126/39 E

(58) Field of Search ..... 126/38, 40, 50, 126/52, 214 R, 212, 214 A, 214 C, 215, 216, 39 E; 431/354, 266

(56) References Cited

U.S. PATENT DOCUMENTS

| | | | | |
|---|---|---|---|---|
| 1,030,118 | * | 6/1912 | O'Neil | 126/52 |
| 1,291,314 | * | 9/1919 | Welsenaar | 126/52 |
| 2,402,997 | * | 7/1946 | Grayson | 126/52 |
| 2,960,157 | | 11/1960 | Dolby . | |
| 3,289,731 | | 12/1966 | Geber . | |
| 5,125,390 | * | 6/1992 | Riehl | 12/39 H |
| 5,133,334 | | 7/1992 | Riehl . | |
| 5,393,224 | * | 2/1995 | Allen et al. | 431/266 |
| 5,443,380 | | 8/1995 | Riehl . | |
| 5,911,572 | | 6/1999 | Williams . | |
| 5,924,860 | * | 7/1999 | Massey et al. | 431/266 |
| 6,030,207 | * | 2/2000 | Salari | 431/354 |

FOREIGN PATENT DOCUMENTS

| | | | | |
|---|---|---|---|---|
| 70 21 709 | | 3/1971 | (DE) . | |
| 197 44 564 | | 1/1999 | (DE) . | |
| 0 033 442 | | 8/1981 | (EP) . | |
| 0 525 299 | | 2/1993 | (EP) . | |
| 0751352 | * | 1/1997 | (EP) | 431/266 |
| 0 964 203 | | 12/1999 | (EP) . | |
| 0964203 | * | 12/1999 | (EP) | 126/39 E |
| WO 98/12475 | | 3/1998 | (WO) . | |

* cited by examiner

*Primary Examiner*—Carl D. Price
(74) *Attorney, Agent, or Firm*—Herbert Dubno; Andrew Wilford

(57) ABSTRACT

A cooktop panel having a throughgoing main mounting hole and upper and lower faces has a burner having a holder underneath the panel, engaging the lower face at the hole, and provided with a gas inlet and a gas nozzle and a burner head mainly above the panel, engaging the upper face at the hole, and forming a downwardly extending intake passage into which the nozzle can feed gas. Fasteners engaged through the panel between the holder and the head retain the holder and head against the respective lower and upper faces. A burner cover atop the burner head forms therewith an annular gas-distribution chamber comunicating with the passage and forms with the burner head an annular array of outlet openings. This cover in formed with an upwardly projecting rack-centering collar defining a central seat. A rack atop the cover is formed centrally with a centering pin engaged in the seat. The holder is formed with a radially projecting mounting arm in turn formed with at least one vertically through-going igniter hole. An igniter engaged in the igniter hole projects through the panel to immediately adjacent the array of outlet openings. The main mounting hole is of a predetermined large diameter or a predetermined small diameter. The holder is formed with an upwardly extending collar fitting in the hole and having a lower large-diameter step corresponding to the predetermined large diameter and an upper small-diameter step corresponding to the predetermined small diameter.

14 Claims, 5 Drawing Sheets

GAS BURNER FOR STOVE

FIELD OF THE INVENTION

The present invention relates to a gas burner. More particularly this invention concerns such a burner used on a commercial- or household-duty gas stove.

BACKGROUND OF THE INVENTION

A standard gas stove has an upper cooktop panel that is formed either of sheet metal or ceramic and that is provided with a plurality of burners. Each burner comprises a burner holder that is mounted underneath the cooktop panel and that is provided with a nozzle connected to a source of propane or butane, a burner head that is mainly above the cooktop panel and that diverts the gas from the nozzle normally into an annular array of jets, and a rack that fits over the head and that is intended to support a cooking utensil. A spark-type electrical igniter is also normally provided at each burner.

The rack normally is fitted with formations made in the cooktop panel. When the panel is made of sheet metal, it is relatively easy to provide appropriate seats for centering fingers on the rack, but when the panel is of ceramic, which is much more difficult to shape and machine, such centering formations are more difficult or impossible to provide. Thus the rack can slide about or be quite difficult to position accurately.

In addition the overall thickness of the cooktop panel varies considerably. When made of enameled steel it is quite thin, and when made of ceramic it is much thicker. In addition due to the difficulty of forming mounting holes in ceramic, the hole in the panel through which the burner extends is normally made larger in ceramic so that screws securing the head to the holder can pass through it, while with a metal panel it is easy to form separate holes for the mounting screws. it is therefore necessary to provide different burner constructions to accommodate the different panel thicknesses as well as the different layout of the mounting screws.

The burners typically vary in size, mainly in diameter. A large burner can in principle have, however, the same support as a small burner and merely needs a larger head and nozzle of greater flow cross section. Due to the larger head, it is necessary to provide the igniter at a different spacing from the center and, since the igniter is mounted on the holder, it has to be spaced differently from the center of the holder for burners of different sizes. Thus using the same holder is normally impossible and it is necessary to provide a separate holder for each burner size.

With many standard systems, large burners are somewhat taller than small burners. Thus a pot sits somewhat higher on a taller burner. This not only creates a nonuniform and unattractive appearance, but makes it impossible to set a cooking utensil, for instance a large kettle, on two adjacent burners of different size.

OBJECTS OF THE INVENTION

It is therefore an object of the present invention to provide an improved gas burner for a stove.

Another object is the provision of such an improved gas burner for a stove which overcomes the above-given disadvantages, which is, for example, of basically standardized construction so that most of its parts can be used both in small and large burners.

A further object is to provide such a burner which can be used both with sheet-metal and ceramic cooktops.

Yet another object is to provide a burner construction that allows a cooking utensil to be set atop more than one burner, even if the burners are of different capacities.

SUMMARY OF THE INVENTION

A cooktop panel having a throughgoing main mounting hole and upper and lower faces has a burner having according to the invention a holder underneath the panel, engaging the lower face at the hole, and provided with a gas inlet and a gas nozzle and a burner head mainly above the panel, engaging the upper face at the hole, and forming a downwardly extending intake passage into which the nozzle can feed gas. Fasteners engaged through the panel between the holder and the head retain the holder and head against the respective lower and upper faces. A burner cover atop the burner head forms therewith an annular gas-distribution chamber communicating with the passage and forms with the burner head an annular array of outlet openings. In accordance with the invention this cover is formed with an upwardly projecting rack-centering collar defining a central seat. A rack atop the cover is for centrally with a centering pin engaged in the seat.

Thus the rack according to the invention is centered on the burner bead. No formations need be made in the cooktop, and the centering formation can be a simple pin which makes fitting the rack in place, for instance after cleaning, a very simple and intuitive operation.

The burner further has according to the invention a cover plate fitting complementarily atop the burner cover and formed with a central hole exposing the seat. This plate can be decorative.

According to another feature of the invention the holder is formed with a radially projecting mounting arm in turn formed with at least one vertically throughgoing igniter hole. An igniter engaged in the igniter hole projects through the panel to immediately adjacent the array of outlet openings. The length of the arm of the holder is enough to accommodate burners of different diameters and more than one hole can be formed in it. Thus the same holder can be used for burners of different size.

The igniter hole according to the invention is provided with a liner sleeve. In addition the panel is formed offset from the main mounting hole with a supplemental hole aligned with the igniter hole and holding the igniter with the igniter hole. The burner head can also be provided with a radially projecting arm formed with a vertically throughgoing hole aligned with the supplemental hole and ignitor hole and holding the igniter therewith.

In accordance with another feature of the invention the main mounting hole is of a predetermined large diameter or a predetermined small diameter. The holder is formed with an upwardly extending collar fitting in the hole and having a lower large-diameter step corresponding to the predetermined large diameter and an upper small-diameter step corresponding to the predetermined small diameter.

Thus with this system the same holder can be used for thick ceramic panels or thin metal panels. Normally the thick ceramic panels have a large hole so that the fastening screws can engage through them. The metal panels with the smaller mounting hole have separate holes through which the mounting screws extend.

The steps according to the invention are cylindrical and coaxial. The mounting holes are usually circular.

According to another feature of the invention the holder is formed with a radially outwardly open groove and the burner cover is formed with a radially outwardly projecting ridge engaged in the groove. This structure ensures that these two parts fit together in the desired angular orientation, which is particularly important for aligning the ignitor with its mounting holes in the panel and head.

The gas-flow passage is constricted as a venturi and normally sucks in air to aid combustion. In addition normally the cooktop is formed with a plurality of such mounting holes each provided with a respective holder, burner head, means, and burner cover. The burner covers all having upper surfaces spaced a predetermined identical distance from the upper panel face. Thus the burners, whether big or small, have an attractive uniform appearance and a cooking utensil can be set stably atop two burners.

BRIEF DESCRIPTION OF THE DRAWING

The above and other objects, features, and advantages will become more readily apparent from the following description, reference being made to the accomanying drawing in which.

SPECIFIC DESCRIPTION

Figure 1:
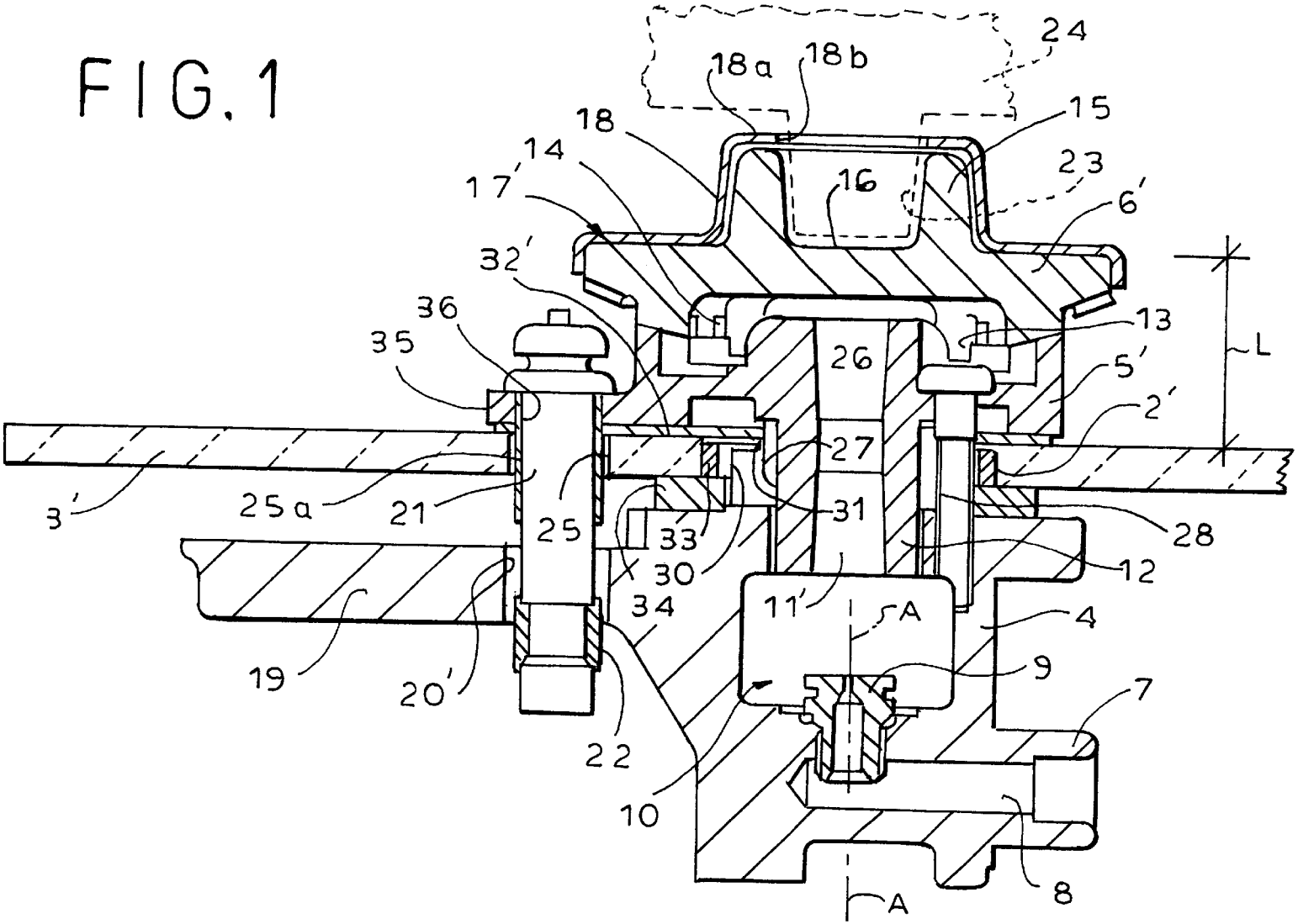
FIGS. 1 and 2 are vertical sections through a burner according to the invention in two different sizes.

As seen in FIGS. 1, 2, 3, and 4 a burner 1', 1", 1*a'*, or 1*a"* according to the invention extends through a hole 2' or 2", in a thick ceramic cooktop panel 3' (FIGS. 1 and 2) or a thinner steel cooktop panel 3" (FIGS. 3 and 4), having a cast-metal burner holder 4 of standardized design below the cooktop 3' or 3" and a small or large burner head 5' or 5" above the cooktop 3' or 3". The burner head 5', 5" has a cover 6', 6", 6*a'* , or 6*a"* that fits complementarily with it.

The standardized holder 4 has an intake fitting 7 for receiving cooking gas which moves through an intake passage 8 to a nozzle 9 dimensioned for the type of gas and burner capacity and defining a central axis A for the burner 1 Thence the gas enters a chamber 10 formed in the holder 4 and passes up through a passage 11 formed by a tube 12 extending downwardly from the head 5', 5" into the holder 4. From the upper end of the tube 12 the gas enters a basically annular distribution chamber 13 in the head 5', 5" and then exits as an annular array of jets from apertures or notches 14 formed between the head 5', 5" and its cover 6', 6", 6*a'* or 6*a".*

Figure 2:
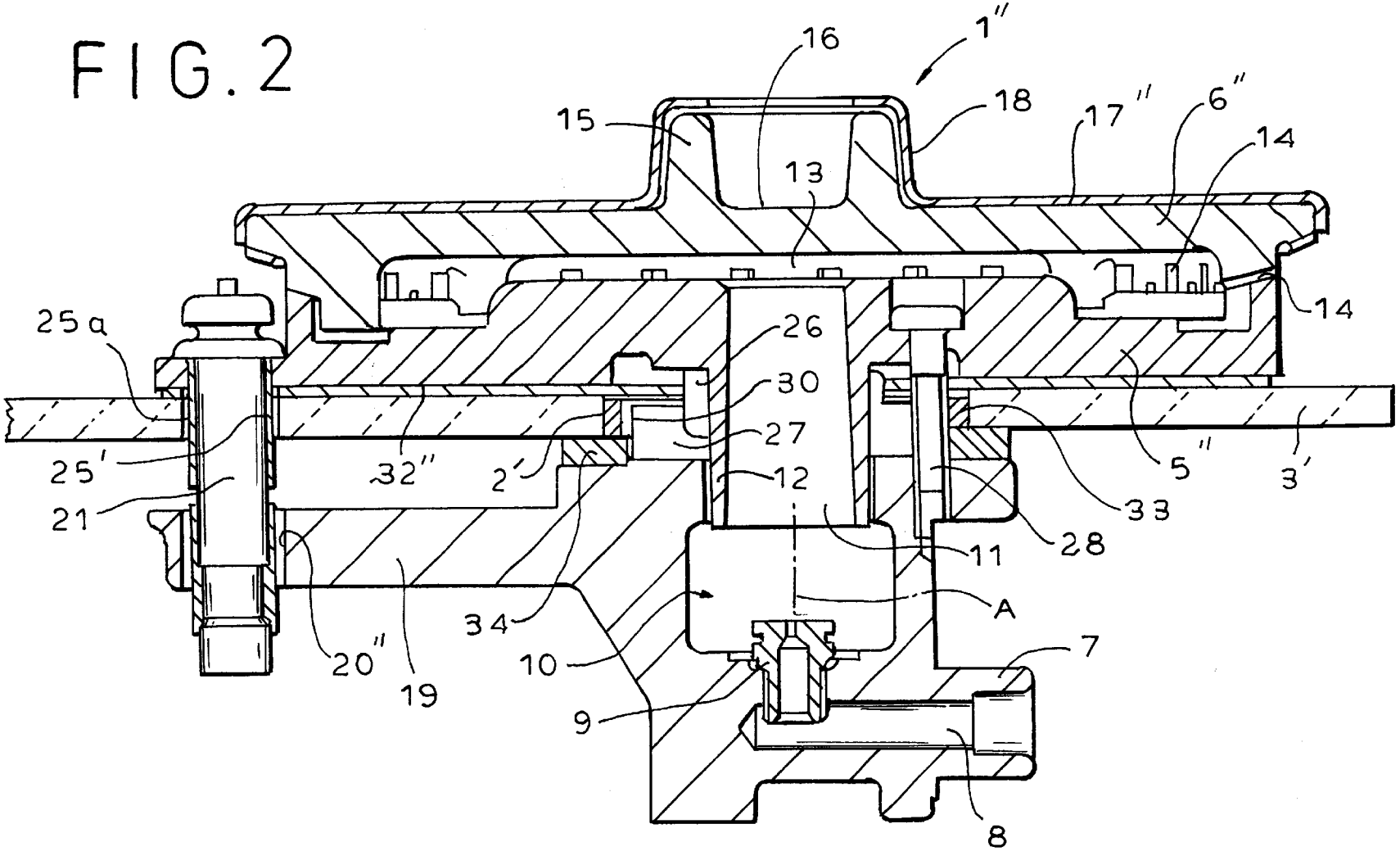

In the arrangement of FIGS. 1 and 2 the head cover 6', 6" is formed centered on the axis A with an upwardly projecting collar 15 forming an axially centered and upwardly open seat 16 adapted to receive a center pin 23 of a rack shown partially at 24 in FIG. 1. For decorative purposes, a sheet-metal cover plate 17', 17" fits over the top of the head cover 6', 6" and has a central formation 18 that fits complementarily with the collar 15, having an inwardly directed lip 18*a* forming a hole 18*b* giving access to the seat 16.

Figure 3:
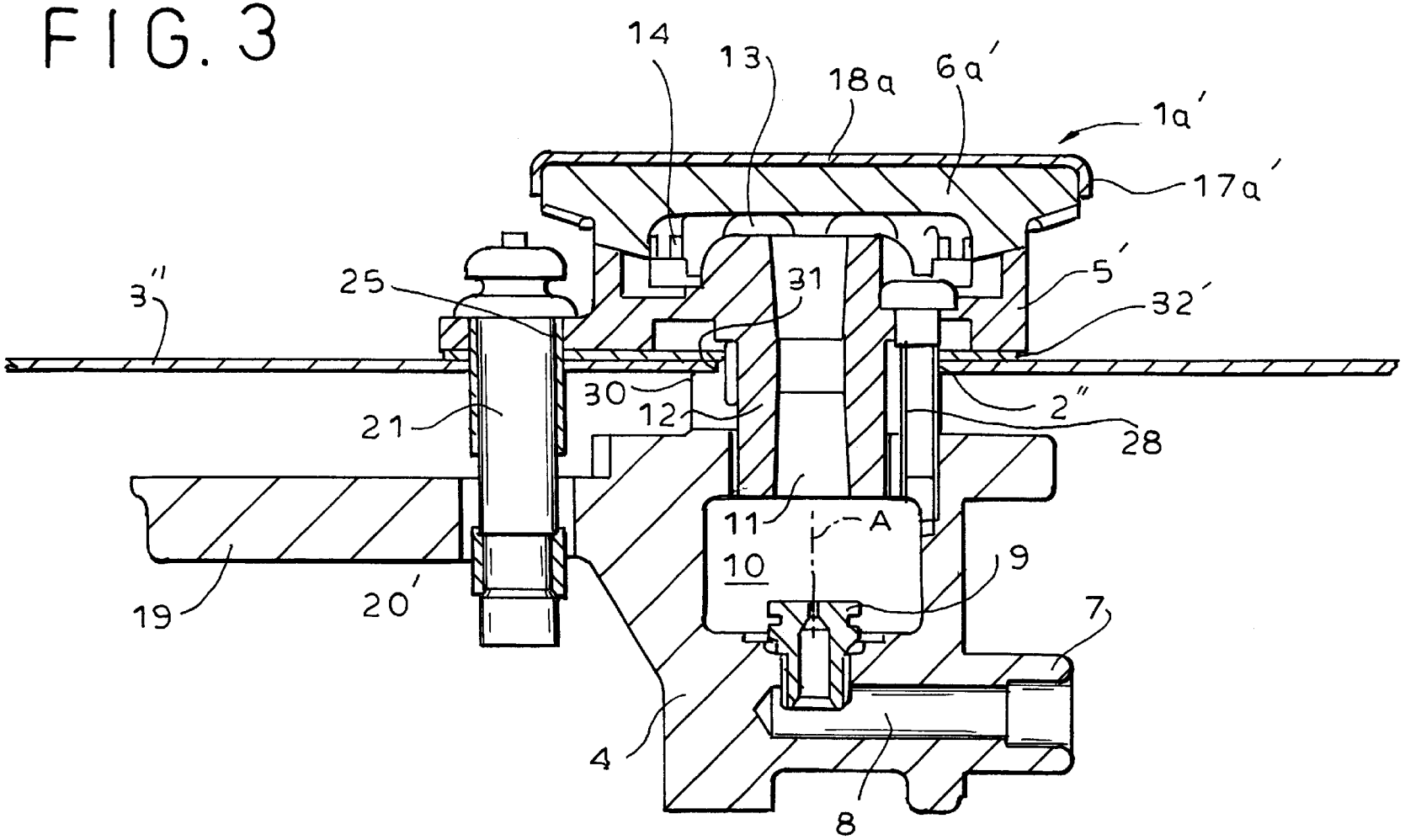
FIGS. 3 and 4 are views like FIG. 1 of another burner in accordance with the invention.
Figure 4:
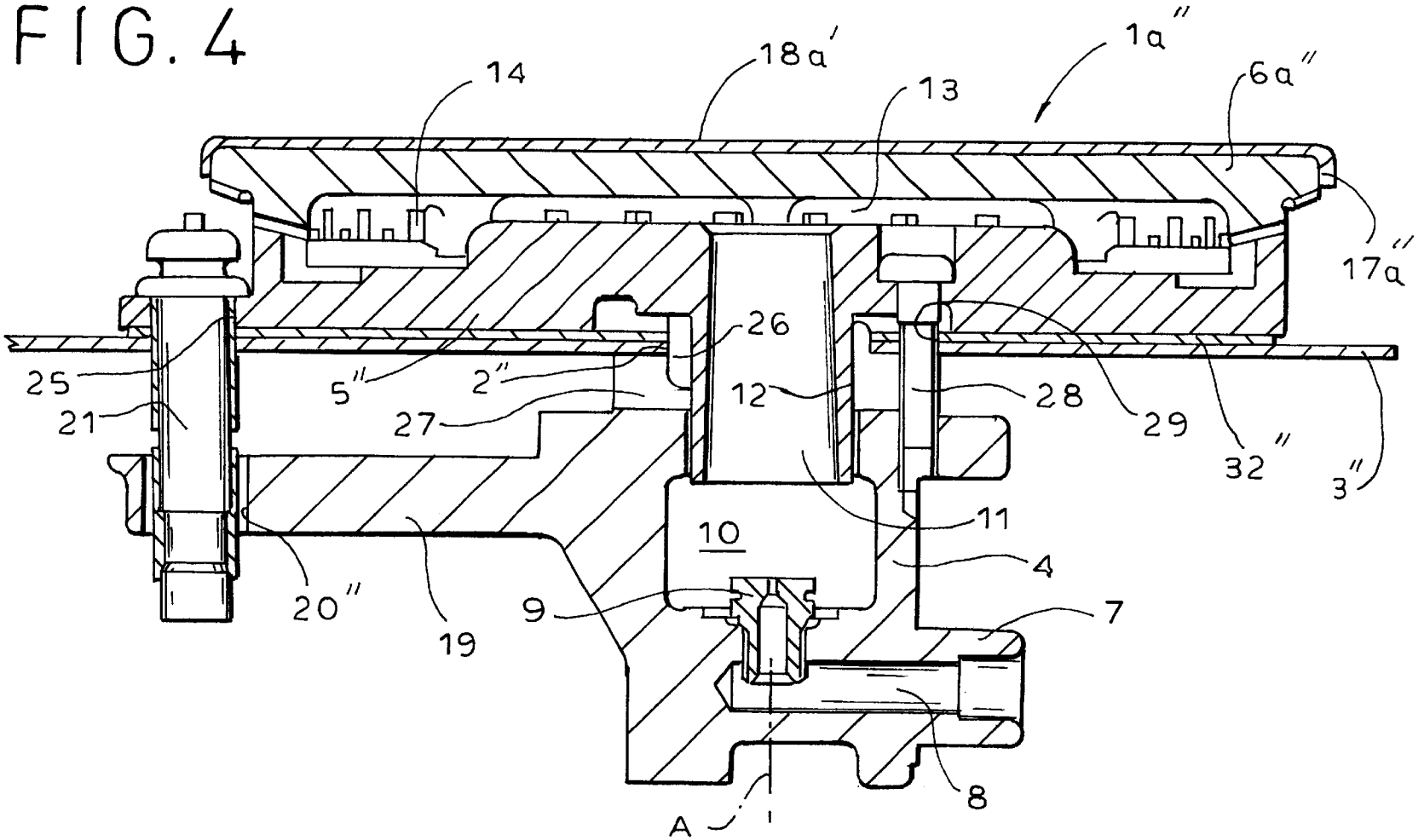

In FIGS. 3 and 4 the structure is identical to that of FIG. 1, except that the cover 6*a'*, 6*a"* has no rack-centering collar 15 and the respective cover plate 17*a'*, 17*a"* has a planar top wall 18*a*, 18*a'*.

Figure 5:
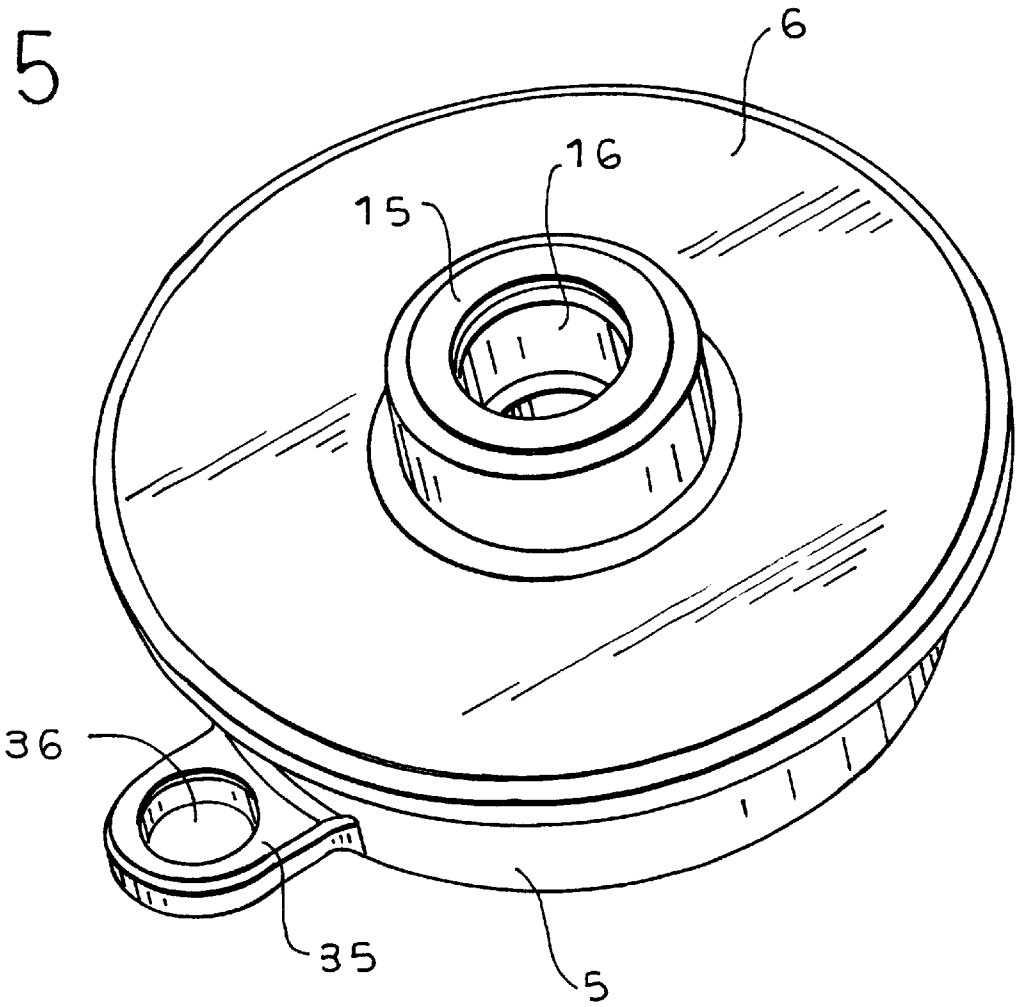
FIG. 5 is perspective view of the burner of FIG. 2.

In both systems the holder 4 is formed with a radially projecting flange or arm 19 formed with a plurality of vertically throughgoing holes 20, 20' adapted to hold an igniter 21 of the standard spark type that is inserted from above. For a small burner as in FIGS. 1 and 3, the hole 20' that is closer to the axis A is used and for a larger burner as in FIGS. 2 and 4, the outer hole 20" is used. Whichever hole 20' or 20" is used, it is provided with a retaining sleeve 22 for the igniter 21. In addition the panel 3', 3" is formed in line with whichever hole 20' or 20" is used with a hole 25 provided with another liner sleeve 25*a*. Furthermore the head 5', 5" is formed with a radially outwardly projecting flange or arm 35 formed with a vertically throughgoing hole 36 (see also FIG. 5) in line with the respective holes 20', 20" and 25. The cover 6, 6' can also he provided with a radially extending arm provided with a hole for the igniter 21 to aid alignment of this part. The igniter 21 is installed from above, so it can easily be repaired or replaced without dismantling the stove.

The head 5', 5" is formed with a radially outwardly projecting and axially extending rib 26 that fits in a complementary groove 27 of the holder 4 to angularly position the head 5', 5" on the holder 4. The holder 4 is formed with a collar having lower and upper steps 30 and 31 respectively of large and small diameter. The large-diameter lower step 30 is adapted to fit in the large-diameter hole 2' formed in the etrmic cooktop 3' which is made large enough to accommodate axially extending screws 28 whose heads bear downward on the head 4' and whose shanks are threaded into the holder 4. The small-diameter upper step 31 is dimensioned to fit in the small-diameter hole 2" formed in a metal cooktop 3", which is formed with separate holes 29 for the screws 28. A large-diameter sheet washer or cushion sheet 32', 32" is provided between the lower face of the head 5', 5" and the upper face of the cooktop 3', 3", another such washer 34 is provided between the upper face of the holder 4 and the lower face of the ceramic cooktop 3', and a further lining sleeve 33 is provided between the inner edge of the hole 2' of the cooktop 3' and the holder 4, as direct metal-to-ceramic contact should be avoided. The sheet 32', 32" has holes corresponding to the main mounting hole 2' or 2" and the ignitor hole 25.

All the burners 1', 1", 1*a'*, 1*a"* according to the invention have a height L above the upper face of the panel 3', 3" that is the same. In addition since the holder 4 and burner head 5', 5" are solidly screwed to each other to opposite sides of the panel 3', 3", the structure is very stable and any spills on the cooktop panel 3', 3" will not run down through the hole 2', 2".

What is claimed is:

1. In combination with a cooktop panel having a throughgoing main mounting hole and upper and lower faces, a burner comprising:

a holder underneath the panel, engaging the lower face at the hole, and provided with a gas inlet and a gas nozzle;

a burner head mainly above the panel, engaging the upper face at the hole, and forming a downwardly extending intake passage into which the nozzle can feed gas;

means engaged through the panel between the holder and the head and retaining the holder and head against the respective lower and upper faces;

a burner cover atop the burner head, forming therewith an annular gas-distribution chamber communicating with the passage, forming with the burner head an annular array of outlet openings centered on an axis, and formed at the axis with an upwardly projecting rack-centering collar defining an axially upwardly open central seat; and a rack atop the cover and formed centrally with an axially downwardly directed centering pin engaged in the seat, the rack being separable from the cover.

2. The burner defined in claim 1, further comprising a cover plate fitting complementarily atop the burner cover and formed with a central hole exposing the seat.

3. In combination with a cooktop panel having a throughgoing main mounting hole and upper and lower faces, a burner comprising:

a holder underneath the panel, engaging the lower face at the hole, provided with a gas inlet and a gas nozzle, and formed with a radially projecting mounting arm extending underneath the panel and formed with at least one vertically throughgoing igniter hole;

a burner head mainly above the panel, engaging the upper face at the hole, and forming a downwardly extending intake passage into which the nozzle can feed gas;

means engaged through the panel between the holder and the head and retaining the holder and head against the respective lower and upper faces;

a burner cover atop the burner head, forming therewith an annular gas-distribution chamber communicating with the passage, and forming with the burner head an annular array of outlet openings; and an igniter engaged in the igniter hole and projecting upward through the panel to immediately adjacent the array of outlet openings.

4. The burner defined in claim 3 wherein the igniter hole is provided with a liner sleeve.

5. The burner defined in claim 3 wherein the panel is formed offset from the main mounting hole with a supplemental hole aligned with the igniter hole and holding the igniter with the igniter hole.

6. The burner defined in claim 5 wherein the burner head is provided with a radially projecting arm formed with a vertically throughgoing hole aligned with the supplemental hole and igniter hole and holding the igniter therewith.

7. The burner defined in claim 5, further comprising a cushion sheet between the burner head and the upper panel face and formed with a large-diameter hole corresponding to the main mounting hole and a small-diameter hole aligned with the igniter hole.

8. In combination with a cooktop panel having a throughgoing main mounting hole of a predetermined large diameter or a predetermined small diameter and upper and lower faces, a burner comprising:

a holder underneath the panel, engaging the lower face at the hole, provided with a gas inlet and a gas nozzle, and formed with an upwardly extending collar fitting in the hole and having a lower large-diameter step corresponding to the predetermined large diameter and an upper small-diameter step corresponding to the predetermined small diameter, one of the steps fitting complementarily in the hole;

a burner head mainly above the panel, engaging the upper face at the hole, and forming a downwardly extending intake passage into which the nozzle can feed gas;

means engaged through the panel between the holder and the head and retaining the holder and head against the respective lower and upper faces; and a burner cover atop the burner head, forming therewith an annular gas-distribution chamber communicating with the passage, and forming with the burner head an annular array of outlet openings.

9. The burner defined in claim 8 wherein the steps are cylindrical and coaxial.

10. The burner defined in claim 8 wherein the means includes screws engaged through the main mounting hole in the case same is of the predetermined large diameter.

11. The burner defined in claim 8 wherein the means includes screws engaged through the panel offset from the main mounting hole in the case is of the predetermined small diameter.

12. In combination with a cooktop panel having a throughgoing main mounting hole and upper and lower faces, a burner comprising:

a holder underneath the panel, engaging the lower face at the main mounting hole and provided with a gas inlet and a gas nozzle, and formed with an upwardly extending collar fitting in the hole and formed with a radially outwardly open groove;

a burner head mainly above the panel, engaging the upper face at the hole, forming a downwardly extending intake passage into which the nozzle can feed gas, and formed with a radially outwardly projecting ridge engaged in the groove, whereby the ridge and groove prevent rotation of the head on the holder;

means engaged through the panel between the holder and the head and retaining the holder and head against the respective lower and upper faces; and a burner cover atop the burner head, forming therewith an annular gas-distribution chamber communicating with the passage, and forming with the burner head an annular array of outlet openings.

13. The burner defined in claim 12 wherein the passage is constricted as a venturi.

14. The burner defined in claim 12 wherein the cooktop is formed with a plurality of such mounting holes each provided with a respective holder, burner head, means, and burner cover, the burner covers all having upper surfaces spaced a predetermined identical distance from the upper panel face.

* * * * *